United States Patent [19]

Krämer et al.

[11] Patent Number: 4,770,149

[45] Date of Patent: Sep. 13, 1988

[54] FUEL INJECTION PUMP FOR INTERNAL COMBUSTION ENGINES

[75] Inventors: Manfred Krämer, Schwieberdingen; Johann Warga, Bietigheim-Bissingen, both of Fed. Rep. of Germany

[73] Assignee: Robert Bosch GmbH, Stuttgart, Fed. Rep. of Germany

[21] Appl. No.: 941,866

[22] Filed: Dec. 15, 1986

[30] Foreign Application Priority Data

Dec. 27, 1985 [DE] Fed. Rep. of Germany ..... 3546222

[51] Int. Cl.[4] ..... F02M 39/00

[52] U.S. Cl. ..... 123/495; 123/509; 123/468

[58] Field of Search ..... 123/495, 372, 364, 365, 123/468, 456, 509; 417/499

[56] References Cited

U.S. PATENT DOCUMENTS

| | | | |
|---|---|---|---|
| 2,106,932 | 2/1938 | Rosen | 123/495 |
| 3,667,437 | 6/1972 | Dreisin | 123/372 |
| 3,712,763 | 1/1973 | Parks | 417/499 |
| 4,543,045 | 9/1985 | Ritter et al. | 417/499 |
| 4,640,255 | 2/1987 | Häfele | 123/495 |

FOREIGN PATENT DOCUMENTS

| | | | |
|---|---|---|---|
| 2146578 | 3/1972 | Fed. Rep. of Germany . | |
| 3326045 | 1/1985 | Fed. Rep. of Germany . | |
| 3509536 | 11/1985 | Fed. Rep. of Germany . | |
| 526537 | 6/1931 | Fed. Rep. of Germany | 123/495 |

OTHER PUBLICATIONS

U.S. patent application Ser. No. 730,616, filed: May 6, 1985, Inventors: W. Häfele, M. Krämer, D. Schmieder, J. Warga; title "Fuel Injectio Pump for Internal Combustion Engines."

*Primary Examiner*—Carl Stuart Miller
*Attorney, Agent, or Firm*—Edwin E. Greigg

[57] ABSTRACT

A fuel injection pump for internal combustion engines having a plurality of pump elements 2, 3 disposed in a line, the injection quantity control of which is effected via a control slide 9 that is axially displaceable on the pump piston 9 and by controlling a relief conduit 22–25 of the pump work chamber 18, the control slides 9 being surrounded by partial suction chambers 8 that discharge into a main suction chamber 10 receiving a torque shaft 12 for axially actuating the control slides 9. These partial suction chambers 8 each have a separate partial inflow conduit 39 of defined length and cross section, which communicates with an inflow conduit 33, so that the same volumetric flow is metered to each partial suction chamber in the manner of quantity division, while the main suction chamber 10 is retained and the torque shaft 12 is disposed in it.

9 Claims, 2 Drawing Sheets

21
20
19
18
32
17
26
22
1
41
2
II
37
10
II
33
39
16
25
15
8
14
23
13
24
29
3
7
31
6
28
4
5

FUEL INJECTION PUMP FOR INTERNAL COMBUSTION ENGINES

BACKGROUND OF THE INVENTION

The invention is based on a fuel injection pump for internal combustion engines as defined hereinafter. Such so-called slide pumps are used primarily for high performance, that is, for use in trucks. With this kind of pump construction, the injection time adjusters needed for adhering to exhaust gas emission regulations and built into the pump drive mechanism, which however are limited in the work they can do, can be dispensed with. In the pump of this generic type, not only exact metering of the injection quantity but very accurate setting of the instant of injection onset can be attained by axially rotating the control slide and/or rotating the pump piston.

In these generic fuel injection pumps, there is inherently a relatively marked temperature development while driving, since because of the high injection pressures not only the mechanical production of heat, but also an overflow of the high-pressure fuel at the metering control edges can lead to heating of the returning fuel, which also heats the fuel located in the suction chamber. As the temperature varies, however, the physical properties such as density and compressibility vary as well, so that the quantity of fuel metered per pumping stroke, as well as its thermal energy content, varies with the temperature of the fuel delivered to the pump work chamber, so that during the ensuing injection, temperature differences in the delivered fuel result in altered performance in the engine cylinders. This effect is disadvantageously further reinforced by the fact that the actual heat sources between the pump piston and the control slide are remote from the actual heat dissipation locations between the pump piston and the pump cylinder, so that the known disadvantage of a lack of heat dissipation is made still worse.

In a known fuel injection pump of this type (German Offenlegungsschrift No. 21 46 578), the fuel is delivered at low pressure to the suction chamber by a feed pump, and from there it is fed via corresponding intake conduits to the pump work chamber during the intake stroke of the pump piston; then, as mentioned above, a portion of this fuel located in the pump work chamber is diverted at high pressure into the suction chamber during the compression stroke, in order to terminate injection supply. While the fuel temperature in the suction chamber near the entrance of the fuel inflow conduit is still relatively cool, because of the large proportion of fresh fuel, this temperature rises until it has attained its maximum in the area where the fuel leaves the suction chamber. The fuel temperatures in the individual pump work chambers of this injection pump differ correspondingly as well, with the consequences noted above. A further factor is that this temperature development also depends on the engine load; that is, at high load and high rpm, relatively little fuel is diverted, while in contrast a considerable quantity of fuel is diverted in the idling range. In any case, however, the ratio of the temperatures in the individual pump work chambers varies relative to one another, thus making it impossible to achieve an adaptation by the engine or some other system of the kind that is achievable when fixed values are involved. A uniform thermodynamic quality over the entire load and rpm range of the engine is attainable only if the fuel delivered to the individual pump work chambers has a largely uniform temperature.

OBJECT AND SUMMARY OF THE INVENTION

The fuel injection pump according to the invention has the advantage over the prior art that the fuel temperature can be maintained the same in all the partial suction chambers, because the volumetric flow is the same in all the partial suction chambers, yet without having to dispense with a shared primary suction chamber, which not only offers the desired storage and has the desired flow calming effect but also contains the necessary space for receiving a rotary shaft. Because of the constant volumetric flow, no differences in fuel temperature arise among the individual partial suction chambers, so that the fuel quantity for optimal combustion, which is to be metered per engine cylinder, can be set extremely accurately, and the heat dissipation for each pumping element can be accomplished at least in part via the fuel that flows through the partial suction chambers and thereby intermittently makes direct contact not only with the control slides but also the pump pistons.

Although it is known (German Offenlenungsschrift No. 33 26 045) to divide the suction chamber of a fuel injection pump into partial suction chambers, that known provision applies only to a conventional in-line injection pump having a completely different design, a different quantity control means and correspondingly different thermodynamic problems. In the in-line injection pump of this known type, the suction chamber surrounds the pump cylinder, so that there is no direct contact with the pump piston. The dissipation of heat from the pump piston must therefore always be effected via the pump cylinder, and the transfer of heat between the pump piston and the cylinder is effected substantially by means of the shared contact surface area, and to a lesser extent, as in the generic pump type, by means of the piston cross section, which is reduced because of its central blind bore. Furthermore, the known pump to its disadvantage has these partial suction chambers disposed on the outflow side of the main suction chamber, so that the heated fuel that is diverted at high pressure mixes in an uncontrolled manner with the fuel present in the main suction chamber and reaches the pump work chambers in this form, which thus leads to the above-described variations in performance among the individual engine cylinders.

According to an advantageous embodiment of the invention, at least one inflow conduit is provided in a manner known from U.S. Pat. No. 4,640,255 which extends parallel to a rotary shaft, for the inflow of fuel, with one partial inflow conduit branching off from it for each pump element. While in this embodiment these partial inflow conduits discharge into the individual pump suction chambers and from there lead either to the pump work chamber or the main suction chamber, in the known pump these partial inflow conduits discharge into a chamber surrounding the pump cylinder and have a fuel outlet. This inflow conduit communicates directly with the fuel feed pump, so that the fuel as proposed in the invention is metered into the partial suction chambers in divided quantities either flows into the individual pump work chambers or else can mix with the diversion quantity, which because of the diversion is substantially the same for all the pump elements, and only then reaches the main suction chamber. A further difference is that this known pump has an additional device in the form of a baffle ring, for attaining satisfactory fuel separation between the cold freshly delivered fuel and the warm fuel already surrounding the cylinders.

In a further embodiment of the invention, at least one bearing plate of the rotary shaft has a diameter greater than the maximum radial dimensions of the rotary shaft having the preassembled driver tangs. Because the main suction chamber is retained according to the invention, as a result of this embodiment of the invention the rotary shaft can be preassembled and coarsely adjusted and can then be introduced into the main suction chamber through the bore which receives the bearing plate. This substantially facilitates assembly.

Once the preassembled rotary shaft is supported in the injection pump, fine adjustment of the driver tangs on the rotary shaft is easily accomplished.

The invention will be better understood and further objects and advantages thereof will become more apparent from the ensuing detailed description of a preferred embodiment taken in conjunction with the drawings.

DETAILED DESCRIPTION OF THE PREFERRED EMBODIMENT

Figure 1:
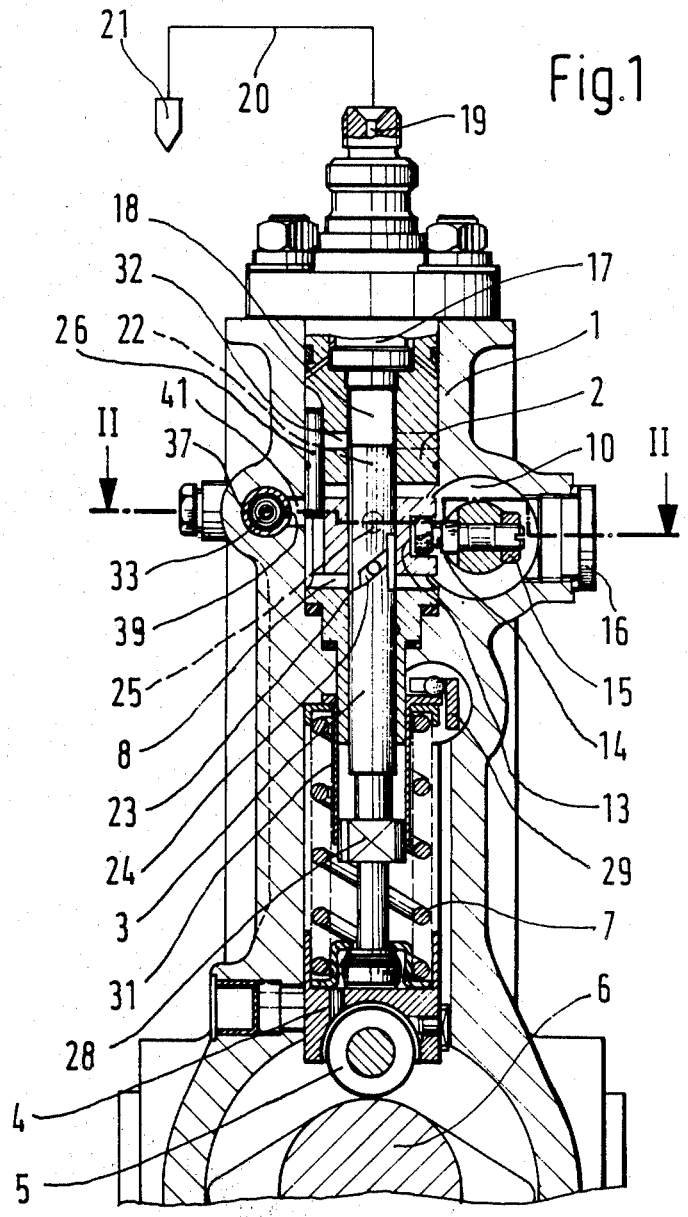
FIG. 1 is a longitudinal section through a fuel injection pump according to the invention, taken along the line I—I of FIG. 2.

In the fuel injection pump shown, six cylinder liners 2 are disposed in a row in a housing 1, and in each of them a pump piston 3 is driven by a camshaft 6, counter to the force of a spring 7, with an interposed roller tappet 4 and roller 5, for its axial movement embodying the working stroke. By means of recesses in the cylinder liners 2, partial suction chambers 8 are formed, each being associated with one pump element comprising a cylinder liner 2 and pump piston 3. One control slide 9 which is axially displaceable on the pump piston 3 is disposed in each of these partial suction chambers 8.

The individual suction chamber 8 discharges on the outflow side into a main suction chamber 10 that extends over the length of the housing 1 and is closed on its lengthwise ends by bearing plates 11. Disposed in this main suction chamber 10 is a rotary shaft 12, which is rotatably supported in the bearing plates 11 and by which the control slides 9 are displaceable. Radially protruding driver tangs 14 that engage a groove 13 of the control slide 9 are provided in transverse bores of the rotary shaft 12, these tangs being in the form of end sections of an eccentric bolt that is fixable by means of a tensioning nut 15 in its position on the rotary shaft 12. In the housing 1, opposite each of these tensioning nuts 15, there is a respective closure device 16, only two of which are shown in the FIG. 2; once the stoppers are removed, the individual driver tangs 14 may be adjusted, after loosening and retightening of the tensioning nuts 15, so as to adjust the individual control sldies 9 with respect to one another in this way.

The pump piston 3, the cylinder liner 2 and a pressure value 17 define a pump work chamber 18, from which a pressure conduit 19 leads to a pressure line 20, shown in simplified form here, which terminates at an injection nozzle 21 of the engine. In the pump piston 3, there are a blind bore 22 which discharges into the pump work chamber 18 and a transverse core 23, which discharges into oblique grooves 24 that are machined into the jacket surface of the pump piston 3 on sides remote from one another. These oblique grooves 24 cooperate with radial bores 25 of the control slide 9 such that they are uncovered by these radial bores 25 after a predetermined stroke of the pump piston 3 has been executed.

To secure the control slide 9 against twisting during its axial displacement on the pump piston 3, so as to assure an exact relationship between the oblique grooves 24 and the radial bores 25, a guide pin 26 is disposed in the cylinder liner 2, and is arranged to engage a longitudinal groove 27 of the control slide 9. The pump piston 3 has a flattened area 28 on its lower portion, which is engaged by a driver member 31 that is rotatable in a known manner by a governor rod 29, so that an axial displacement of the governor rod effects a rotation of the pump piston 3 and thus a change in the relationship of the oblique grooves 24 and the radial bores 25 to one another.

In the cylinder liner 2, an intake bore 32 is provided, which is uncovered by the pump piston 3 in its bottom dead center position (as shown in the drawing).

The supply of fuel to the individual partial suction chambers 8 is effected in common for all six partial suction chambers 8 through an inflow conduit 33. The fuel not attaining injection flows out of the partial suction chamber 8 into the main suction chamber 10 and from there via a outflow nipple 34 into a return line 34 shown in simplified form, which leads to the fuel tank (not shown) or to the intake side of a presupply pump (also not shown) of the injection pump. The outflow nipple 34 is disposed in one of the closure devices 16 of the main suction chamber 10, specifically in the device 16 that is located farthest away with respect to the entrance of the inflow conduits 33, or in other words diagonally on the other side of the pump. A pressure valve 36 is provided in the return line 35 in order to maintain a minimum fuel pressure in the main suction chamber 10. The inflow conduit 33 extends within a tube 37 preferably made of insulating material, which is introduced into a longitudinal bore 38 of the pump housing 1. The inflow conduit 33 disposed in the tube 37 is stepped, with segments of which the cross section tapers in the flow direction; from each segment, a branch bore 39 disposed radially in the tube 37 leads to the respective partial suction chamber 8. Openings 41 are provided as a flow connection between the longitudinal bore 38 which receives the tube 37 and the partial suction chambers 8 in the housing 1. These openings 41 correspond with the radial branch bores 39.

The inflow conduit 33 also may be embodied as having a smooth bore; here the criterion is that during operation all the pump elements are to be supplied constantly with the same volumetric flow. Between the pressure in the inflow conduit 33 and that in the partial suction chamber 8 or main suction chamber 10, there is a pressure drop, because of the throttling effect of the radial branch bores 39. According to the invention, the cross sections and length of these radial branch bores 39 are matched to one another such that the volumetric flow through the bores is the same for all cylinders, the cylinders being for example six in number. As a result, there is a stable and uniform distribution of the delivered fuel to the individual pump elements. The rotational position of the tube 37 is fixed by means of a fixation screw 42 extending within the housing 1.

The diameter of the bearing plates 11 for the rotary shaft 12 is selected to be large enough that the rotary shaft 12 can be preassembled; that is, the bolts forming the driver tangs 14 are secured to the rotary shaft 12 by means of the tensioning nuts 15, before the rotary shaft 12 is introduced into the main suction chamber 10. The diameter of the bores 43 in the housing that receive the bearing plates 11 is thus greater than the length of the bolts.

Figure 2:
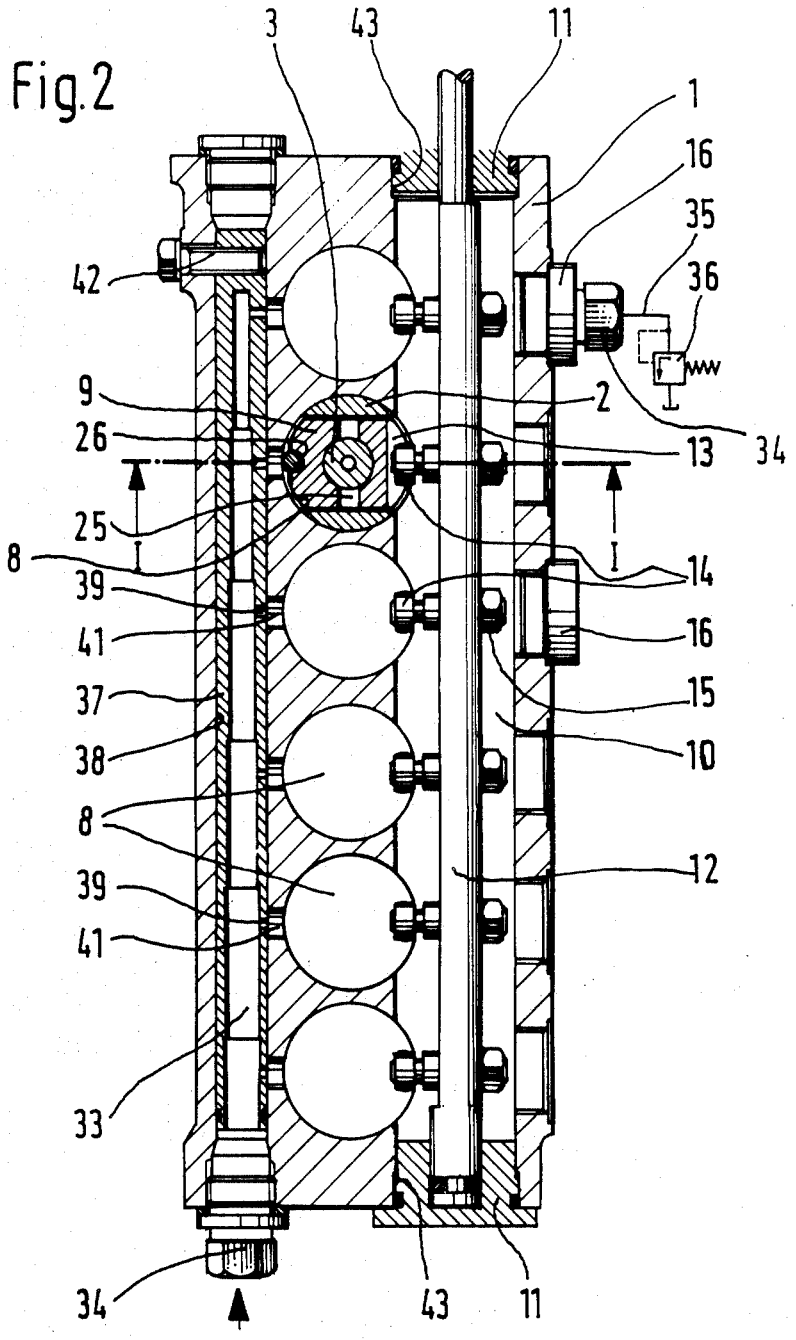
FIG. 2 is a cross section taken through this pump along the line II—II of FIG. 1, with various structural parts omitted to better illustrate the invention.

The fuel injection pump shown in FIGS. 1 and 2 operates as follows:

During at least part of the intake stroke of the pump piston 3, and in the vicinity of bottom dead center of its stroke motion, fuel flows out of the partial suction chambers 8 via the oblique grooves 24, the transverse bore 23 and the blind bore 22 as well as the intake bore 32, into the pump work chamber 18. During the ensuing compression stroke of the pump piston 3, a pressure required for injection builds up in the pump work chamber 18 only once these inflow conduits between the partial suction chambers 8 and the pump work chamber 18 are blocked. Until that time, fuel flows back out of the pump work chamber 18 to the partial suction chamber 8 via these conduits. After the closure of these inflow conduits, the high pressure required for injection builds up in the pump work chamber 18, and the supply to the engine, and injection, then begins. Once the high-pressure stroke of the pump piston 3 has been executed, the pump work chabmer 18 is made to communicate with the partial suction chamber 8, so that the fuel continuing to be pumped is diverted at high pressure into the partial suction chambers 8. This effective injection stroke of the pump piston 3 is determined by the rotational position of the pump piston 3, to which a predetermined distance of the oblique grooves 24 from the radial bores 25 corresponds, so that a variably long stroke of the pump piston 3 must be traversed before this uncovering action takes place and makes the pump work chamber 18 communicate with the partial suction chamber 8 via the blind bore 22, the transverse bore 23 and the oblique bores 24, so as to end the injection.

Through the inflow conduit 33 and the radial branch bores 39 as well as the openings 41 fuel having an identical volumetric flow is delivered to each of the partial suction chamber 8 at a constant inflow pressure and a constant suction chamber pressure, and hence at a constant pressure drop, so that a uniform pump work chamber charge of fuel at an identical temperature is assured even during extreme operation (high rpm and load).

The foregoing relates to a preferred exemplary embodiment of the invention, it being understood that other variants and embodiment thereof are possible within the spirit and scope of the invention, the latter being defined by the appended claims.

What is claimed and desired to be secured by Letters Patent of the United States is:

1. A fuel injection pump for internal combustion engines, having a plurality of pump elements disposed in line in a pump housing and driven by a common camshaft, each having one pump piston and one pump cylinder and defining a pump work chamber, a control slide axially displaceable on each pump piston and controlling at least one control opening that discharges into the jacket face of the pump piston and communicates with a central blind bore of the pump piston that is open toward the pump work chamber, a suction chamber that surrounds the individual control slides and is defined by the pump housing and has an inlet side and outlet side through which fuel flows at low pressure, a governor rod which is provided for simultaneously rotating each of said pump pistons for controlling the quantity of fuel supply, and a rotary shaft which is provided for simultaneously actuating all the control slides for controlling the onset and end of fuel supply, said rotary shaft being supported in the pump housing and provided with adjustable driver tangs, a partial suction chamber (8) arranged to surround each said control slide (9) and discharge on said outflow side in a common main suction chamber (10), each said partial suction chamber (8) being provided with a defined partial inflow conduit (39) through which the same amount of fuel quantity is metered to each partial suction chamber (8) under the influence of a pressure drop generated by the partial inflow conduit (39), said rotary shaft (12) is extended through the suction chamber (10) and is supported at its ends in said pump housing (1) in bearing plates (11), said pump housing includes at least one inflow conduit (33) arranged to extend parallel to said rotary shaft (12), and said partial inflow conduits (39) branch off therefrom to said partial suction chambers (8).

2. A fuel injection pump as defined by claim 1, in which said inflow conduit (33) extends within a tube (37), said tube being provided with radial branch bores (39) that lead, as partial inflow conduits, to said partial suction chambers (8).

3. A fuel injection pump as defined by claim 2, in which said tube (37) is introduced into a housing bore (38), which communicates with said partial suction chambers (8) via openings (41) associated with said partial flow conduits (39).

4. A fuel injection pump as defined by claim 3, in which said tube (37) is made of thermal insulation material.

5. A fuel injection pump as defined in claim 2, in which said inflow conduit (33) in said tube (37) is embodied as a stepped bore, said stepped bore further including conduit segments each of which have different diameters and a radial bore (39) arranged to branch off from said stepped bore.

6. A fuel injection pump as defined by claim 3, in which said inflow conduit (33) in said tube (37) is embodied as a stepped bore, said stepped bore further including conduit segments each of which have different diameters and a radial bore (39) arranged to branch off from said stepped bore.

7. A fuel injection pump as defined by claim 4, in which said inflow conduit (33) in said tube (37) is embodied as a stepped bore, said stepped bore further including conduit segments each of which have different diameters and a radial bore (39) arranged to branch off from said stepped bore.

8. A fuel injection pump as defined by claim 1, in which said outlet from said main suction chamber (10) is disposed on a portion of said pump housing (1) that is remote from said inlet side of said inflow conduit.

9. A fuel injection pump as defined by claim 1, in which at least one bearing plate (11) of the rotary shaft (12) has a diameter which is greater than the largest radial dimension of the rotary shaft (12) including said adjustable driver tangs (14).

* * * * *